US007931466B2

(12) United States Patent
McFatter, II

(10) Patent No.: US 7,931,466 B2
(45) Date of Patent: Apr. 26, 2011

(54) FLARE GAS FLAMMABILITY CONTROL

(75) Inventor: William E. McFatter, II, Lake Jackson, TX (US)

(73) Assignee: Equistar Chemicals, LP, Houston, TX (US)

( * ) Notice: Subject to any disclaimer, the term of this patent is extended or adjusted under 35 U.S.C. 154(b) by 486 days.

(21) Appl. No.: 12/214,910

(22) Filed: Jun. 24, 2008

(65) Prior Publication Data

US 2009/0317754 A1 Dec. 24, 2009

(51) Int. Cl.
*F23G 7/08* (2006.01)

(52) U.S. Cl. ..... 431/5; 431/12; 700/274

(58) Field of Classification Search ..... 431/5, 12; 700/274

See application file for complete search history.

(56) References Cited

U.S. PATENT DOCUMENTS 2,072,384 A * 3/1937 Schmidt ..... 137/6
3,833,335 A * 9/1974 Lazarre et al. ..... 431/202
3,891,847 A * 6/1975 Schmidt et al. ..... 250/342
4,122,897 A * 10/1978 Capp et al. ..... 166/256
4,154,567 A * 5/1979 Dahmen ..... 431/5
4,369,803 A * 1/1983 Furr ..... 137/6
4,472,936 A * 9/1984 Uchiyama et al. ..... 60/773
4,739,714 A * 4/1988 LaSpisa et al. ..... 110/187
4,900,244 A * 2/1990 Keller et al. ..... 431/5
5,061,463 A * 10/1991 Vickery ..... 423/210
5,261,378 A * 11/1993 Fenchel et al. ..... 123/501
5,484,279 A * 1/1996 Vonasek ..... 431/202
5,823,124 A * 10/1998 Koppang ..... 110/345
6,278,899 B1 * 8/2001 Piche et al. ..... 700/44
6,361,310 B1 * 3/2002 Fastnacht et al. ..... 431/12
6,744,046 B2 * 6/2004 Valaskovic et al. ..... 250/288
6,908,297 B2 * 6/2005 Dafft et al. ..... 431/4
6,950,711 B2 * 9/2005 Havener et al. ..... 700/28
6,977,372 B2 * 12/2005 Valaskovic et al. ..... 250/288
7,698,004 B2 * 4/2010 Boyden et al. ..... 700/52
2002/0190203 A1 * 12/2002 Valaskovic et al. ..... 250/288
2003/0018399 A1 * 1/2003 Havener et al. ..... 700/28
2003/0190569 A1 * 10/2003 Dafft et al. ..... 431/5
2004/0173743 A1 * 9/2004 Valaskovic et al. ..... 250/288
2008/0295405 A1 * 12/2008 Davis et al. ..... 48/197 R

* cited by examiner

*Primary Examiner* — Kenneth B Rinehart
*Assistant Examiner* — Jorge Pereiro

(57) ABSTRACT

A plant gas to be flared in the atmosphere is periodically sampled and analyzed as to its Btu content, a first comparison made of 1) the most recent of such analyses with 2) a predetermined steady state set point, a second comparison made of 3) an average of a plurality of such analyses including an historical minimum Btu content with 4) a predetermined dynamic set point, and fuel added to the plant gas based on the larger fuel requirement of these first and second comparisons.

6 Claims, 1 Drawing Sheet

FLARE GAS FLAMMABILITY CONTROL

BACKGROUND OF THE INVENTION

1. Field of the Invention

This invention relates to the atmospheric flaring of one or more gas streams that are generated in an industrial plant. In particular, this invention relates to the flaring of one or more gas streams from a chemical plant.

2. Description of the Prior Art

Although this invention will, for sake of clarity and brevity, be described in relation to a polymer production plant wherein olefins are joined together to form polyolefins, this invention is not so limited, it being applicable to essentially any plant that generates at least one gas stream suitable for flaring (combustion).

Periodically in the operation of an industrial plant, particularly chemical plants, one or more gas streams are generated that have no further use, and must be disposed of in an acceptable manner. Often this waste plant gas is combustible (flammable), i.e., has a British thermal unit (Btu) content suitable for disposal by combustion in the ambient atmosphere by use of a conventional flare assembly known in the art. However, the combustibility of such a plant gas stream can be too low for efficient combustion in the atmosphere, and/or combustion in an environmentally acceptable manner. For example, the Btu content of the plant gas can be so low it would, upon burning, have a much lower destruction efficiency and thus allow higher amounts of hydrocarbons than is acceptable to be released into the atmosphere.

Thus, a predetermined minimum Btu content target value (predetermined minimum Btu value) is set in which the plant gas to be disposed of must contain before it can be passed to a flare for combustion. Sometimes the actual Btu content of the plant gas stream is sufficient to meet this predetermined minimum Btu value. In this situation, the plant gas can be burned without the need for additional combustion enhancing fuel, e.g., natural gas, to raise the Btu content of that plant gas at least to the predetermined minimum Btu value. Other times the actual Btu content of the plant gas is below this predetermined minimum Btu value and additional flammability enhancing fuel must be added to the plant gas stream in an amount sufficient to raise its Btu content at least to meet this predetermined minimum Btu value. It all depends on the chemical make-up of the plant gas stream. However, this chemical make-up can vary widely and randomly particularly when the gas stream is a composite of a plurality of gas streams formed in separate parts of the plant, and then combined into a single flare gas stream.

Sometimes the actual Btu content of the gas stream is essentially the same (steady state or stable) as to flow rate (quantity) and chemical composition, and if this was always the case it would be relatively easy to calculate how much additional fuel, if any, was required to get the Btu content of the gas stream up to its particular predetermined minimum Btu value.

Other times, and sometimes often, the actual Btu content of the final gas stream to be combusted varies, and in an unpredictable manner since the stream can be composed of a number of different waste streams of varying chemical compositions and quantities. This random variance of characteristics of the final gas stream to be flared renders the maintenance of its predetermined minimum Btu value problematic.

One solution for this problem is to employ, based on plant history, a large excess of additional combustion enhancing fluid fuel so that the plant gas stream to be flared always has a final Btu content well above any level needed in the past, thereby, theoretically always meeting its predetermined minimum Btu value. However, this approach is based only on past performance, and some plants can generate gas streams in the future that have a lower Btu content than ever experienced in the past. Also, this approach is wasteful of added fuel when the actual Btu content of the gas stream is, from time to time, at or above its predetermined minimum Btu value, so this approach can prove expensive.

The challenge then is always to meet the predetermined minimum Btu content target value while using only the minimum amount of added fuel, and to do so whether the actual Btu content and other characteristics of the plant gas stream is stable or randomly varying in composition, flow rate, and the like.

This invention meets that challenge.

SUMMARY OF THE INVENTION

Pursuant to this invention, the final plant gas stream to be combusted is sampled and analyzed on a periodic basis before flaring to determine on a regular basis its actual Btu content. A first comparison is then conducted of 1) the most recent such analyses and 2) a predetermined steady state set point. A second comparison is also conducted of 3) an average of a plurality of such analyses, including a historical minimum Btu content of past gas streams that have been flared and 4) a predetermined periodic (varying) set point. Btu enhancing fuel is added or not added to the actual gas stream to be flared based on the larger fuel requirement of these first and second comparisons.

DETAILED DESCRIPTION OF THE INVENTION

Figure 1:
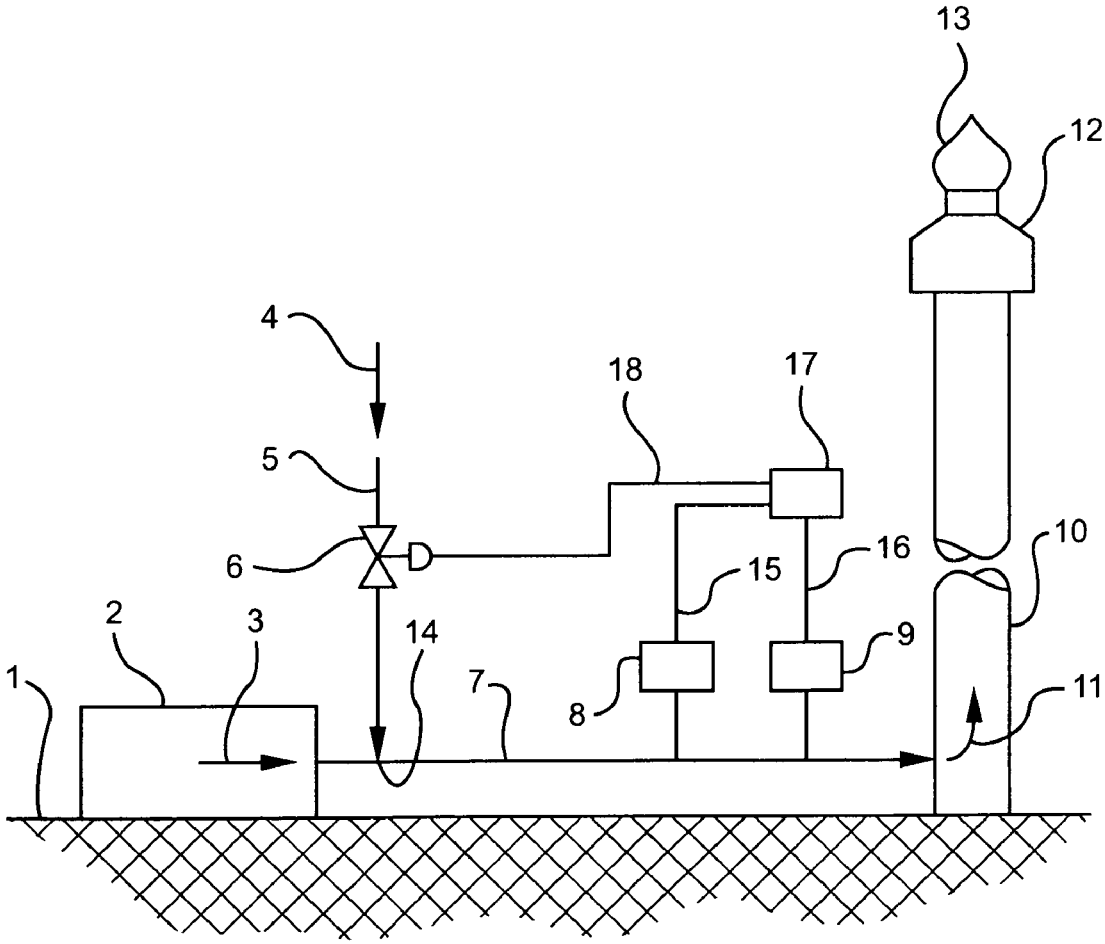
FIG. 1 shows a schematic of a conventional plant flare and equipment useful in carrying out the process of this invention.

FIG. 1 shows the earth's surface 1 carrying an industrial plant 2, e.g., a polyolefin plant or oil refinery, which produces a number of disparate waste gas streams that have varying Btu contents, chemical compositions, and flow rates. These waste streams are combined into a final plant gas stream 3 which is passed by way of conduit 7 to atmospheric flare assembly 10.

A flammability enhancing fuel 4 such as natural gas can be added to stream 3 inside conduit 7 by way of conduit 5 which conduit carries a metering valve 6.

Downstream of the point of introduction of fuel 4, a conventional flow meter 8 is operatively connected to the interior of conduit 7 to measure the varying flow rates of stream 3, including fuel 4 if any such fuel has been added to stream 3 at point 14 of conduit 7.

Downstream of flow meter 8, pipe 7 has operatively connected to its interior a conventional gas chromatographic sampler and analyzer 9. Suitable analyzers are well known in the art and commercially available, e.g., Maxim by Applied Automation Analyzer 9 periodically samples the stream carried in conduit 7 upstream of flare 10, and downstream of both flow meter 8 and the point 14 of fuel 4 addition. Analyzer 9 then analyzes each such sample for its actual Btu content.

The outputs of meter 8 and analyzer 9 are passed by way of electrical conduits 15 and 16 to a computer 17. Computer 17 can be any comparative computer well known in the art and commercially available, e.g., Provox System by Emerson.

Stream 3 plus added fuel 4, if any, passes into and upwards inside flare 10 as shown by arrow 11 until it reaches flare tip 12 at which time it is combusted by way of flame 13.

Plant gas stream 3 has an initial actual Btu content as it leaves plant 2 inside conduit 7. Based of the general nature of the chemical composition of stream 3, the particular burning capabilities of flare 10, the atmospheric emissions requirements in the geographical region where flare 10 is located, and the like, a predetermined minimum Btu content target value is determined based on the flaring permit issued for flare 10 by the responsible regulatory agency. Stream 3 cannot be burned in flame 13 for any appreciable length of time if its actual Btu content is less than this predetermined minimum Btu value. Although it can vary widely, for sake of clarity of description, and as an operating example for a cracking plant, this predetermined minimum value will, hereafter in this description, be taken as 300 Btu per standard cubic foot of gas (Btu/SCF).

If stream 3 has an initial actual Btu content less than 300 Btu/SCF, additional fuel 4 must be added through valve 6 by way of line 5. Fuel 4 is added in a quantity such that stream 11 will have a Btu content of at least 300 per SCF. Thus, the amount of fuel 4 added to stream 3 can vary from zero to whatever amount is necessary to raise the Btu content of stream 3 at least to 300 before it reaches flare 10.

Gas chromatograph 9 periodically, e.g., every 10 minutes (6 times an hour), takes a physical sample from the gas stream 3 inside conduit 7, and analyzes that specific sample for its actual Btu content. Flow rate meter 8 continually measures the flow rate of stream 3 plus added fuel 4, if any.

Pursuant to this invention, the predetermined minimum Btu value of 300 that is necessary for stream 11 can be at least met 1) under steady state operating conditions where the actual Btu content of stream 3 is consistently below 300, 2) under dynamic operating conditions where the actual Btu content of stream 3 varies randomly and repeatedly to values above and below the 300 Btu/SCF set point, and 3) any sequential combinations of steady state and dynamic conditions. This invention can adjust to these varying conditions of operation, including varying flow rates, and consistently maintain stream 11 at or above 300 Btu/SCF, and can do so using a minimum amount of added fuel 4.

Thus, this invention employs a steady state determination when there is essentially no significant change in the Btu content or flow rate of stream 3 in conduit 7, and a dynamic condition determination when the Btu content of stream 3 varies irregularly above and below the 300 set point and/or the flow rate of stream 3 varies.

The steady state and dynamic condition set points are variables that, as close as reasonably possible, meet a desired functional and economic balance between avoiding an undesired excursion, i.e., flaring of stream 11 with a Btu content of less than 300 Btu/SCF on a periodic, e.g., hourly, basis, while avoiding the addition of more fuel 4 than necessary consistently to meet this 300 set point.

These steady state and dynamic conditions set points are sensitive to the particular flaring apparatus employed, and the various operating conditions under which that flare is employed. Accordingly, with innumerable differing flare assemblies operating in the industries that employ flares, the great variation of flaring operating conditions, and the substantial variety of plant gas chemical compositions there are literally an infinite number of these set points that can exist. Thus, it is impossible to quantify this universe of set points. However, one skilled in the art, once appraised of this invention can readily determine the desired set points for a given plant, flare assembly, and gas stream compositions to be combusted. Therefore, further detail in this regard is not necessary to inform the art.

In respect of the steady state component of this invention, using the flow rate at meter 8 at the time of taking the most recent (latest) gas chromatographic sample, and the Btu content value from that most recent gas chromatographic analysis, the amount of fuel 4 needed, if any, to meet the aforesaid steady state set point is determined by computer 17.

In respect of the dynamic conditions component of this invention, first a historical minimum Btu content (value) for stream 3 is determined. This historical value is determined based on a significant time period, e.g., 60 consecutive days, of the actual operation of flare 10. This historical value can be zero if less than 60 days of actual operational data are available. Although this significant time period can cover 60 or more consecutive days of operational time, it desirably covers a calendar year of operational data in order to cover all seasons of the year and thereby account for seasonal weather variations.

Next in the dynamic conditions component, a plurality of the latest gas chromatographic analyses as to Btu content of stream 3 are averaged in computer 17 along with the historical minimum Btu content value aforesaid to give a minimum possible Btu value. For example, if the gas chromatographic sampling and analysis procedure is carried out every 10 minutes, the results from averaging 1) the last five analyses as to Btu content together with 2) the historical minimum Btu content value aforesaid will give a resulting average number that can be characterized as an "hourly average value." Put another way, the aforesaid averaging will be the sum of the Btu content results of five separate analyses taken ten minutes apart plus the historical minimum Btu value, divided by six. Periodicities of other than every ten minutes for an hourly average value can be employed within this invention so long as a plurality of recent analyses are averaged with a historical minimum Btu value to obtain a minimum possible dynamic Btu value. These calculations are also done by computer 17.

In the last step of the dynamic conditions component, the minimum possible Btu value, e.g., the hourly average value aforesaid, is compared with the predetermined dynamic set point aforesaid to determine if, based on the minimum possible Btu value, additional fuel 4 is required to be added to stream 3 in order to meet the predetermined dynamic conditions set point aforesaid. This comparison is carried out by computer 17.

In the final step in the process of this invention, the amount of fuel 4 determined to be necessary to meet the steady state set point is compared to the amount of fuel 4 determined to be necessary to meet the dynamic conditions set point, and the larger fuel requirement for fuel 4 is actually added to stream 3 by way of operation of valve 6 in line 5. This final determination is made by computer 17 which, once the determination is made, opens valve 6 as necessary by way of an electrical signal from line 18 to admit the requisite amount of fuel 4 into the interior of line 7, and thereby raise the Btu content of stream 3 to at least 300 Btu/SCF under essentially all conditions of steady state and dynamic variation.

I claim:

1. In a process wherein a plant gas stream is combusted in a flare assembly, said plant gas stream having a flow rate and an initial actual Btu content, said plant gas stream having a predetermined minimum Btu content target value to be met before it is combusted in said flare assembly, said initial actual Btu content being at least one of an essentially steady state Btu content and a dynamic Btu content that randomly moves above and below said predetermined minimum Btu content target value, the improvement comprising providing a source of fuel that can be added to said plant gas stream at least one addition point, measuring the flow rate of said plant gas stream downstream of said at least one addition point, periodically sampling said plant gas stream downstream of said at least one addition point, analyzing each said sample for its initial actual Btu content, said sampling and analyzing steps being conducted a finite number of times over at least one predetermined time period, selecting a steady state Btu content set point and a dynamic Btu content set point, making a first comparison of the analysis results of the most recent of said initial actual Btu contents with said steady state set point and determining the amount of fuel required to be added, if any, to said plant gas stream to raise the Btu content of that stream at least to said steady state set point, obtaining a historical minimum Btu content for said flare assembly based on the operation of said assembly over a time period, averaging the results of the analyses of a plurality of recent initial actual Btu contents plus said historical minimum Btu content, making a second comparison of said averaging results with said dynamic set point and determining the amount of fuel required to be added, if any, to said plant gas stream to raise the Btu content of that stream at least to said dynamic set point, and adding fuel to said plant gas stream based on the larger fuel requirement of said first and second comparisons.

2. The method of claim 1 wherein said steady state and dynamic set points are based on the specific combustion characteristics of said flare assembly and are chosen so as to carry out said combustion of said plant gas stream at least at said predetermined minimum Btu content target value without the addition of said fuel to said plant gas stream in quantities that substantially exceed those necessary to meet said predetermined minimum Btu content target value.

3. The method of claim 1 wherein said plant gas stream periodic sampling over a predetermined time period is at least every 10 minutes over each 60 minute period.

4. The method of claim 1 wherein said historical minimum Btu content over a time period is determined over an operating period for said flare assembly of at least about 60 days.

5. The method of claim 1 wherein said plurality of most recent initial Btu contents that are averaged are the 5 most recent taken, and said average is the sum of said last 5 most recently taken plus said historical minimum Btu content divided by 6.

6. The method of claim 1 wherein said plant flare gas is from a polyolefin production plant, said fuel is essentially natural gas, and said predetermined minimum Btu content target value is at least about 300 Btu/SCF.

* * * * *